US012053097B1

(12) United States Patent
Luo

(10) Patent No.: US 12,053,097 B1
(45) Date of Patent: Aug. 6, 2024

(54) ANTI-COLLAPSE INFLATABLE MATTRESS

(71) Applicant: G SHARK CO., LTD., Denver, CO (US)

(72) Inventor: Ting Luo, Jinhua (CN)

(73) Assignee: G SHARK CO., LTD., Denver, CO (US)

( * ) Notice: Subject to any disclaimer, the term of this patent is extended or adjusted under 35 U.S.C. 154(b) by 0 days.

(21) Appl. No.: 18/431,936

(22) Filed: Feb. 3, 2024

(30) Foreign Application Priority Data

Jan. 16, 2024 (CN) ..... 202420106922.X

(51) Int. Cl.
*A47C 27/08* (2006.01)

(52) U.S. Cl.
CPC ..... *A47C 27/082* (2013.01)

(58) Field of Classification Search
CPC ..... A47C 27/08; A47C 27/081; A47C 27/082; A47C 27/127; A47C 27/15; A47C 27/17; A61G 7/05769
USPC ..... 5/706, 711, 712
See application file for complete search history.

(56) References Cited

U.S. PATENT DOCUMENTS 948,644 A * 2/1910 Bjornstad ..... A47C 27/081 5/712
1,610,898 A * 12/1926 Steiner ..... A47C 27/081 5/712
1,627,835 A * 5/1927 Combs ..... A47C 27/087 5/255
2,318,492 A * 5/1943 Johnson ..... A47C 27/087 5/712
2,887,692 A * 5/1959 Gosman ..... A47C 27/081 297/DIG. 3
3,707,009 A * 12/1972 Wagner ..... A47C 27/144 428/116
4,425,676 A * 1/1984 Crane ..... A61G 7/05746 5/689
5,044,030 A * 9/1991 Balaton ..... A47C 27/081 5/687
5,552,205 A * 9/1996 Lea ..... A47C 17/70 5/420
7,353,555 B2 * 4/2008 Lau ..... A47C 27/081 5/711
8,146,184 B2 * 4/2012 Lin ..... A47C 21/048 5/710
2009/0165211 A1 * 7/2009 Song ..... A47C 27/081 5/706

(Continued)

*Primary Examiner* — David R Hare
(74) *Attorney, Agent, or Firm* — Zhigang Ma

(57) ABSTRACT

An anti-collapse inflatable mattress includes: an inflatable mattress body, which includes: a top sheet, a side sheet, and a bottom sheet that together define an inflatable cavity; the anti-collapse inflatable mattress further includes: a vertical partition layer disposed in the inflatable cavity and including: a first support frame and a second support frame that are disposed in a cross manner; and top portions of the first and second support frames are connected to the top sheet; bottom portions of the first and second support frames are connected to the bottom sheet; and the first support frame and the second support frame intersect in an X shape to form the vertical partition layer disposed between the top sheet and the bottom sheet. The anti-collapse inflatable mattress has a reasonable structure, strong practicality, convenient use, safety, and can prevent from collapse and extend its service life.

10 Claims, 4 Drawing Sheets

(56) References Cited

U.S. PATENT DOCUMENTS

| | | | | |
|---|---|---|---|---|
| 2014/0237727 | A1* | 8/2014 | Xia | A47C 27/087 5/711 |
| 2015/0113736 | A1* | 4/2015 | Cox | A47C 27/087 5/655.3 |
| 2018/0027985 | A1* | 2/2018 | Ocegueda Gallaga | A47C 27/081 |

* cited by examiner

ANTI-COLLAPSE INFLATABLE MATTRESS

TECHNICAL FIELD

The disclosure relates to the technical field of mattresses, particularly to an anti-collapse inflatable mattress.

BACKGROUND

Sleep is a basis of health. In addition to work, life, physical and psychological reasons, healthy bedding with hygiene, comfort, beauty, and durability is also a key to obtain high quality sleep. With continuous progresses of material civilization and technology, types of mattresses used by modern people are gradually becoming more diverse, mainly divided into spring mattresses, palm mattresses, latex mattresses, waterbed mattresses, inflatable mattresses, and magnetic mattresses.

The inflatable mattresses include pull-up inflatable mattresses, the pull-up inflatable mattress refers to a type of mattress that expands in volume after inflation, and the pull-up inflatable mattress is easy to carry and is popularized.

At present, due to a concentrated force at a connection between a pull strap and a mattress body of the pull-up inflatable mattress, the connection between the pull strap and the mattress body is prone to breakage, resulting in local collapse of the pull-up inflatable mattress and shortening its service life.

SUMMARY

A main objective of the disclosure is to provide an anti-collapse inflatable mattress with a reasonable structure, strong practicality, convenient use, and safety. Furthermore, the anti-collapse inflatable mattress can be capable of preventing an inflatable mattress body from collapse and prolonging a service life thereof.

In order to achieve the above objective, the disclosure provides an anti-collapse inflatable mattress (also referred as to an inflatable mattress), including an inflatable mattress body; the inflatable mattress body includes: a top sheet, a side sheet, and a bottom sheet; and the top sheet, the side sheet, and the bottom sheet together define an inflatable cavity; the anti-collapse inflatable mattress further includes: a first vertical partition layer disposed in the inflatable cavity, the first vertical partition layer includes: a first support frame and a second support frame, and the first support frame and the second support frame are disposed in a cross manner; and a top portion of the first support frame and a top portion of the second support frame are connected to the top sheet; a bottom portion of the first support frame and a bottom portion of the second support frame are connected to the bottom sheet; and the first support frame and the second support frame intersect in an X shape to form the first vertical partition layer disposed between the top sheet and the bottom sheet.

In an embodiment, the anti-collapse inflatable mattress further includes: a second vertical partition layer and a third vertical partition layer that are disposed in the inflatable cavity; and the first vertical partition layer, the second vertical partition layer, and the third vertical partition layer are identical in shape and size.

In an embodiment, the first support frame and the second support frame are made of a hard material or a soft material.

In an embodiment, the inflatable mattress body further includes: a composite partition layer; and the composite partition layer includes: a surrounding partition, an oblique partition, and a transverse partition; the oblique partition is disposed on the surrounding partition, and the transverse partition is disposed on the oblique partition; and the oblique partition is connected to the top sheet, and the transverse partition is connected to the side sheet.

In an embodiment, the inflatable mattress body further includes: an inflation port.

In an embodiment, the inflatable mattress body further includes: a motor inflation port disposed at a side of the inflation port.

In an embodiment, the composite partition layer defines an air hole connected to the inflatable cavity.

Beneficial effects of the disclosure are that: the anti-collapse inflatable mattress provided by the disclosure includes the inflatable mattress body; the inflatable mattress body includes: the top sheet, the side sheet, and the bottom sheet; and the top sheet, the side sheet, and the bottom sheet together define the inflatable cavity; the anti-collapse inflatable mattress further includes: the first vertical partition layer disposed in the inflatable cavity, and the first vertical partition layer includes: the first support frame and the second support frame that are disposed in a cross manner; and the first support frame and the second support frame intersect in the X shape to form the first vertical partition layer disposed between the top sheet and the bottom sheet.

Through the above settings in view of a structure of the anti-collapse inflatable mattress, the disclosure is safer and more reliable to use, and effectively prevents the inflatable mattress from collapse, making the inflatable mattress more convenient to use.

The disclosure further sets the composite partition layer, which provides traction forces to the top sheet, the side sheet, and the bottom sheet of the inflatable mattress, allowing the inflatable mattress to distribute the traction forces to each component of the inflatable mattress and effectively increasing a performance of anti-collapse for the inflatable mattress. Therefore, the disclosure has strong practicality, reasonable structure, and is suitable for universal promotion and use.

BRIEF DESCRIPTION OF DRAWINGS

In order to provide a clearer explanation of embodiments of the disclosure or technical solutions in the related art, the following will be given a brief introduction on attached drawings required in describing the embodiments or the related art. Apparently, the attached drawings in the following description are only some of the embodiments of the disclosure. For those skilled in the related art, other attached drawings can be obtained based on structures illustrated in the attached drawings without any creative effort.

Figure 1:
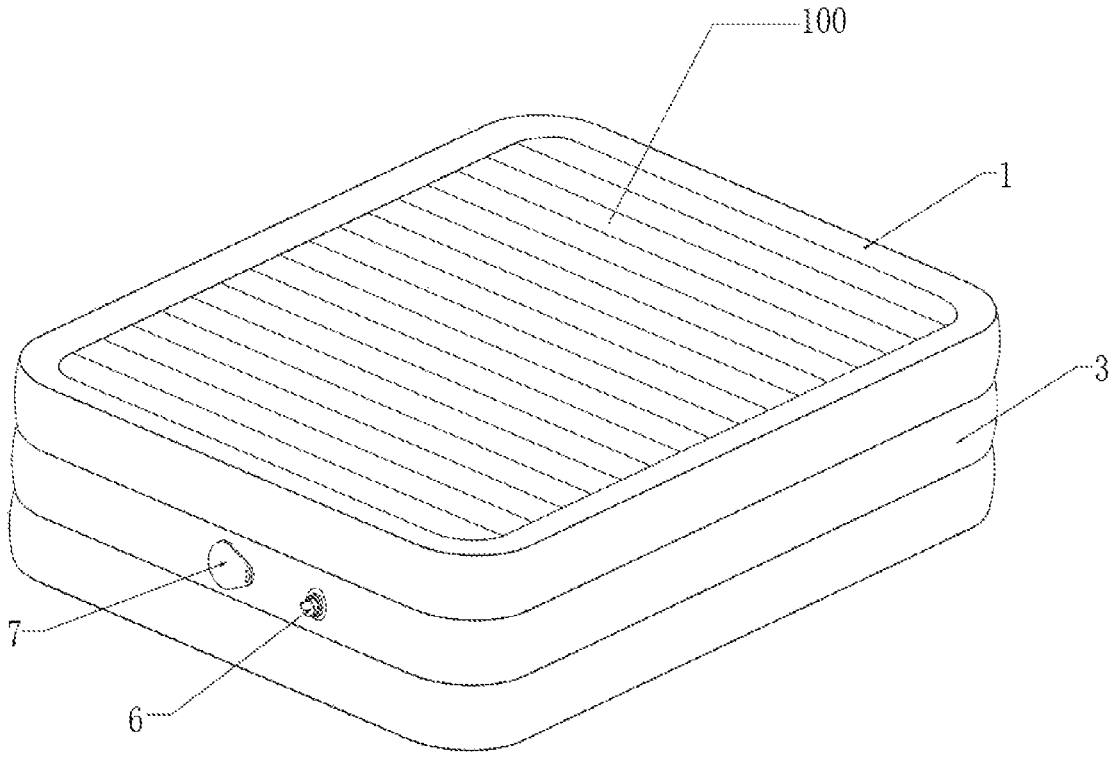
FIG. 1 illustrates a schematic structural diagram of an anti-collapse inflatable mattress according to an embodiment of the disclosure.
Figure 2:
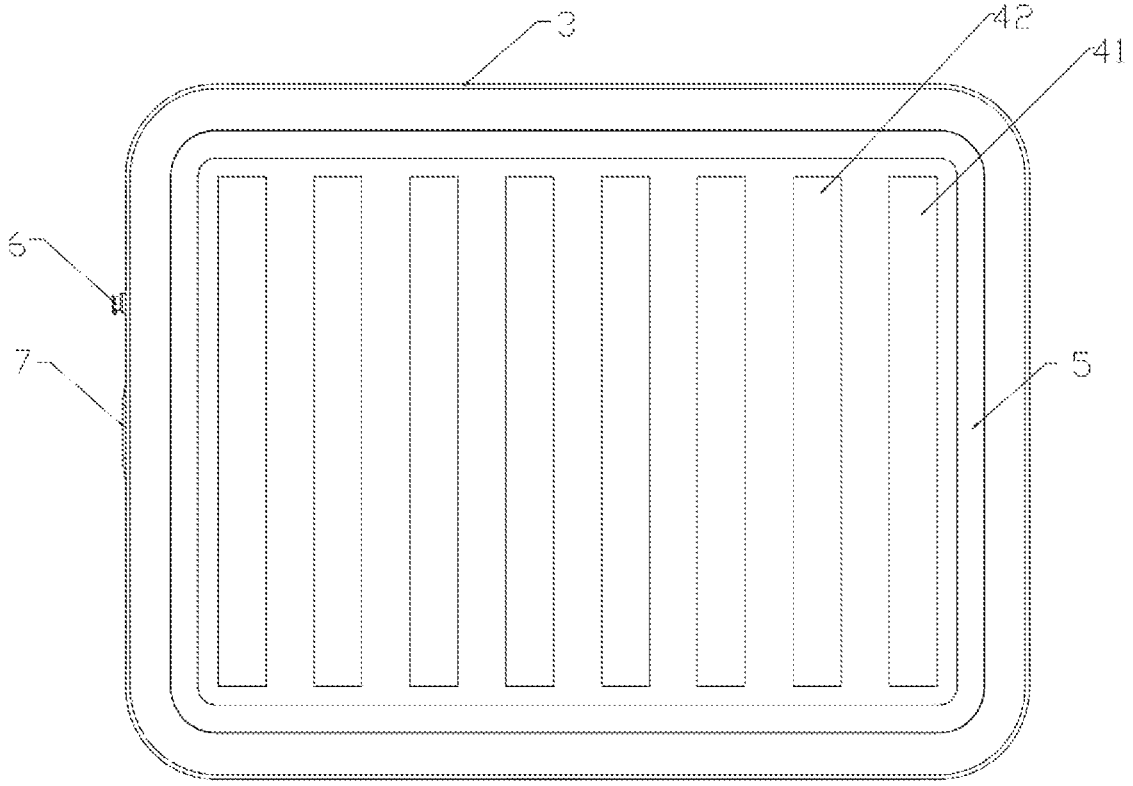
FIG. 2 illustrates another schematic structural diagram of the anti-collapse inflatable mattress according to an embodiment of the disclosure.

An implementation of the objective, and functional features and advantages of the disclosure will be further described with reference to the attached drawings in combination with the embodiments.

DETAILED DESCRIPTION OF EMBODIMENTS

The following will provide a clear and complete description of the technical solutions in the embodiments of the disclosure in conjunction with the attached drawings. Apparently, the described embodiments are only some of the embodiments of the disclosure, not all of the embodiments. Based on the embodiments in the disclosure, all other embodiments obtained by those skilled in the related art without creative effort fall within the scope of the protection of the disclosure.

It should be noted that all directional indications (such as up, down, left, right, front, rear . . . ) in the embodiments of the disclosure are only used to explain the relative position relationship, motion situation, etc. between components in a specific posture (as shown in the attached drawings). If the specific posture changes, the directional indications can also change accordingly.

In the disclosure, unless otherwise clearly defined and limited, the terms "connection", "fixation", etc. should be understood broadly. For example, "fixation" can be a fixed connection, a detachable connection, or an integrated body; can also be a mechanical connection or an electrical connection; can further be a direct connection or an indirect connection through an intermediate medium, which can be an internal connection between two components or an interaction relationship between the two components, unless otherwise specified. For those skilled in the related art, specific meanings of the above terms in the disclosure can be understood based on specific circumstances.

In addition, if there are descriptions of "first", "second", etc. in the embodiments of the disclosure, the descriptions of "first", "second", etc. are only used for descriptive purposes and cannot be understood as indicating or implying relative importance among the embodiments or implying the number of indicated technical features. Therefore, the features limited to "first" and "second" can explicitly or implicitly include at least one of these features. In addition, the meaning of "and/or" appearing in the description includes three parallel technical solutions. Taking "A and/or B" as an example, it includes a technical solution A, or a technical solution B, or a technical solution including A and B. In addition, the technical solutions between the various embodiments can be combined with each other, but must be realized by those skilled in the related art. When a combination of the different technical solutions conflicts or cannot be achieved, it should be considered that the combination of such technical solutions does not exist and not fall within the scope of the protection required by the disclosure.

The disclosure provides an anti-collapse inflatable mattress.

Embodiment 1

With reference to FIG. 1, FIG. 2, FIG. 3, FIG. 4, and FIG. 5, in an embodiment of the disclosure, the anti-collapse inflatable mattress includes: an inflatable mattress body 100, and the inflatable mattress body 100 includes: a top sheet 1, a side sheet 3, and a bottom sheet 2; and the top sheet 1, the side sheet 3, and the bottom sheet 2 together define an inflatable cavity 9. Moreover, the anti-collapse inflatable mattress further includes: a first vertical partition layer 41 disposed in the inflatable cavity 9; the first vertical partition layer 41 includes: a first support frame 411 and a second support frame 412; and the first support frame 411 and the second support frame 412 are disposed in a cross manner.

A top portion of the first support frame 411 and a top portion of the second support frame 412 are connected to the top sheet 1; a bottom portion of the first support frame 411 and a bottom portion of the second support frame 412 are connected to the bottom sheet 2; and the first support frame 411 and the second support frame 412 intersect in an X shape to form the first vertical partition layer 41 that is disposed between the top sheet 1 and the bottom sheet 2.

In an embodiment, the first support frame 411 and the second support frame 412 are disposed in the inflatable cavity 9, and the first support frame 411 and the second support frame 412 are disposed in the cross manner. Furthermore, the first support frame 411 and the second support frame 412 intersect in the X shape to form the first vertical partition layer 41 disposed between the top sheet 1 and the bottom sheet 2.

In the embodiment, the first vertical partition layer 41 is connected to the top sheet 1 and the bottom sheet 2 by setting a fixed length for the first vertical partition layer 41. Therefore, the first vertical partition layer 41 can provide support inside the inflatable mattress body 100, and enable the top sheet 1 and the bottom sheet 2 remain flat while using the anti-collapse inflatable mattress. Moreover, the first vertical partition layer 41 can resist a lateral shear force, making the inflatable mattress (also referred as to the anti-collapse inflatable mattress) according to the disclosure more stable and less prone to deformation.

In an illustrated embodiment, the first support frame 411 and the second support frame 412 are made of a hard material or a soft material.

Figure 3:
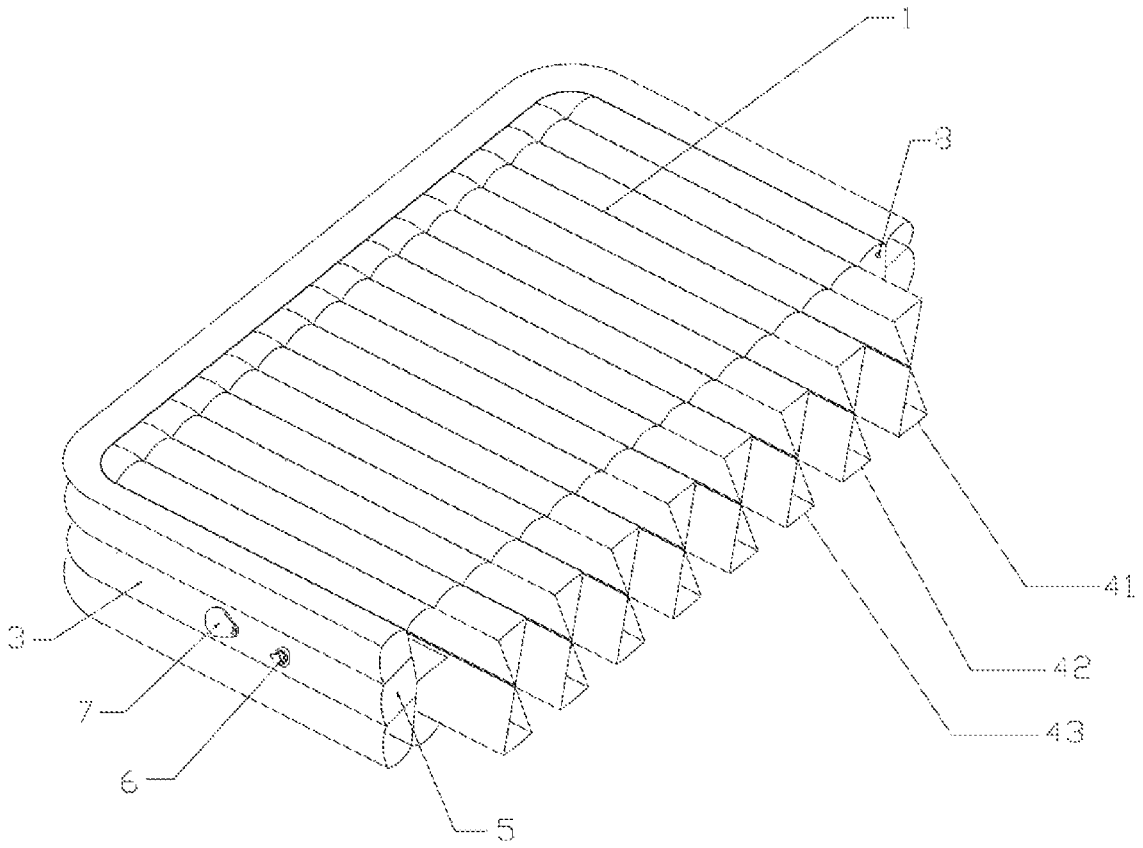
FIG. 3 illustrates still another schematic structural diagram of the anti-collapse inflatable mattress according to an embodiment of the disclosure.
Figure 4:
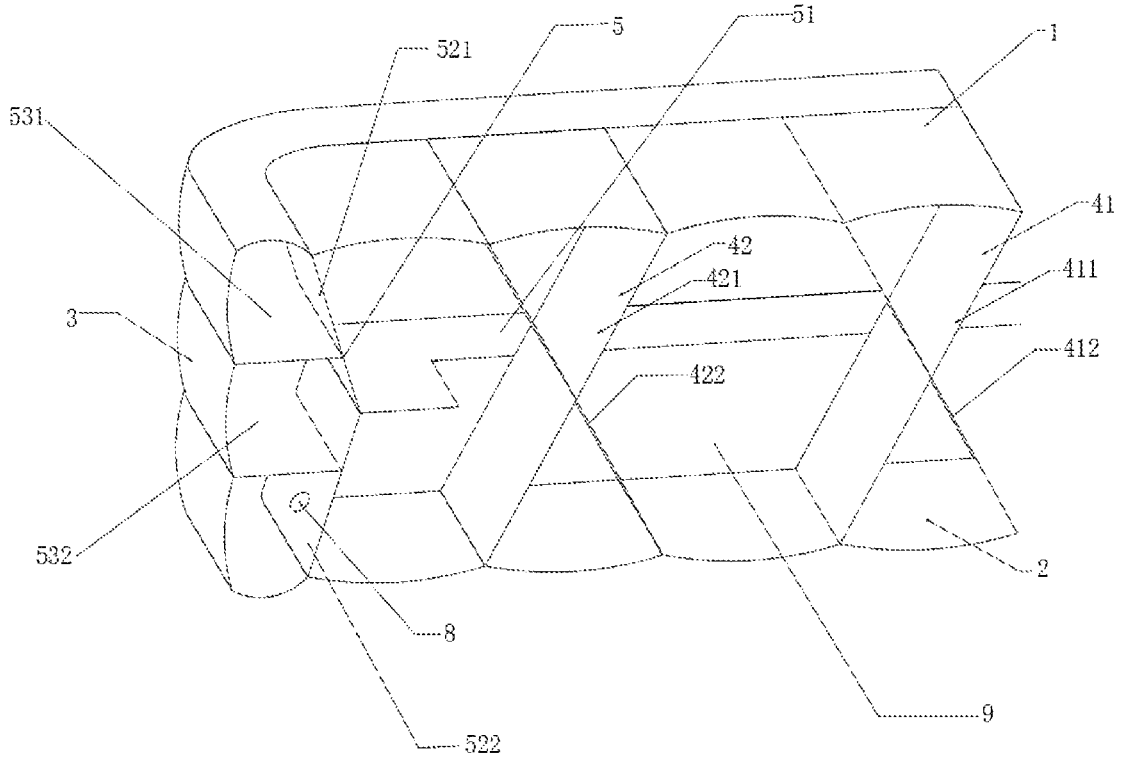
FIG. 4 illustrates a schematic structural diagram of an inflatable cavity of the anti-collapse inflatable mattress according to an embodiment of the disclosure.
Figure 5:
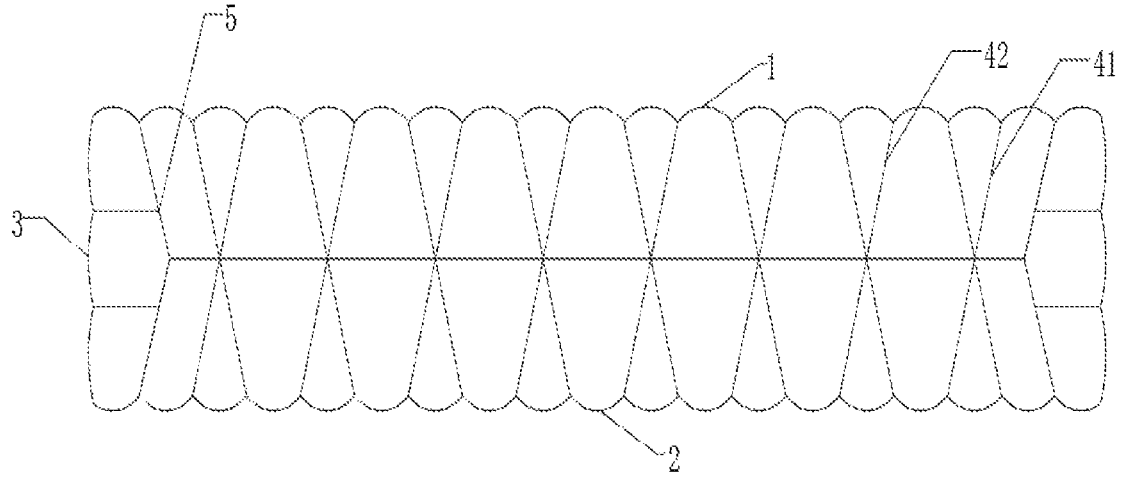
FIG. 5 illustrates a schematic structural diagram of the anti-collapse inflatable mattress according to an embodiment of the disclosure.

With reference to FIG. 3, FIG. 4, and FIG. 5, in an illustrated embodiment, the anti-collapse inflatable mattress includes: the first vertical partition layer 41, a second vertical partition layer 42, and a third vertical partition layer 43 that are disposed in the inflatable cavity 9; and the first vertical partition layer 41, the second vertical partition layer 42, and the third vertical partition layer 43 are identical in shape, size, and structure.

In an embodiment, the second vertical partition layer 42 includes: a third support frame 421 (equal to the first support frame 411) and a fourth support frame 422 (equal to the second support frame 412), and the third support frame 421 and the fourth support frame 422 are disposed in a cross manner.

A top portion of the third support frame 421 and a top portion of the fourth support frame 422 are connected to the top sheet 1; a bottom portion of the third support frame 421 and a bottom portion of the fourth support frame 422 are connected to the bottom sheet 2; and the third support frame 421 and the fourth support frame 422 intersect in an X shape to form the second vertical partition layer 42 disposed between the top sheet 1 and the bottom sheet 2.

In an embodiment, the anti-collapse inflatable mattress can be equipped with multiple vertical partition layers disposed in the inflatable cavity 9 according to actual needs, and the multiple vertical partition layers include but are not limited to the vertical partition layers forming in the X shape. The disclosure is designed to set the multiple vertical partition layers to provide support inside the inflatable mattress body 100, to enable the top sheet 1 and the bottom sheet 2 remain flat during the use of the anti-collapse inflatable mattress according to the disclosure, and to enable the multiple vertical partition layers to resist the lateral shear forces, thereby making the anti-collapse inflatable mattress more stable and less prone to deformation.

With reference to FIG. 4 and FIG. 5, in an illustrated embodiment, the inflatable mattress body 100 further includes: a composite partition layer 5; the composite partition layer 5 includes: a surrounding partition 51 and a first oblique partition 521, and the first oblique partition 521 is disposed on the surrounding partition 51. It should be noted that the surrounding partition 51 is 回-shaped, i.e., the surrounding partition 51 is hollow, and the multiple vertical partition layers are surrounded by the surrounding partition 51. In an illustrated embodiment, the composite partition layer 5 includes: the first oblique partition 521 and a second oblique partition 522; and the first oblique partition 521 and the second oblique partition 522 are disposed above and below relative to the surrounding partition 51, respectively (i.e., the first oblique partition 521 and the second oblique partition 522 being symmetrically disposed relative to the surrounding partition 51).

The composite partition layer 5 further includes: a first transverse partition 531; the first transverse partition 531 is disposed on the first oblique partition 521; and the first oblique partition 521 is connected to the top sheet 1, and the first transverse partition 531 is connected to the side sheet 3.

The composite partition layer 5 further includes: a second transverse partition 532; the second transverse partition 532 is disposed on the second oblique partition 522; and the second oblique partition 522 is connected to the bottom sheet 2, and the second transverse partition 532 is connected to the side sheet 3.

In an embodiment, the composite partition layer 5 provides traction forces to the top sheet 1, the side sheet 3, and the bottom sheet 2, allowing the inflatable mattress to distribute the traction forces to each component (e.g., the top sheet 1, the side sheet 3, and the bottom sheet 2) and effectively increasing a performance of anti-collapse for the inflatable mattress.

With reference to FIG. 1, FIG. 2, FIG. 3, FIG. 4, and FIG. 5, in an illustrated embodiment, the inflatable mattress body 100 further includes: an inflation port 6. The inflation port 6 is used to inflate and deflate the anti-collapse inflatable mattress in a physical manner, making the anti-collapse inflatable mattress more convenient to use.

In an illustrated embodiment, the inflatable mattress body further includes: a motor inflation port 7 disposed at a side of the inflation port 6.

The motor inflation port 7 is used to inflate or deflate the anti-collapse inflatable mattress through an electric inflation motor, so that the anti-collapse inflatable mattress according to the disclosure is more convenient to use.

In an illustrated embodiment, the composite partition layer 5 defines an air hole 8 connected to the inflatable cavity 9.

In an embodiment, the inflatable cavity 9 can be divided into multiple inflatable chambers, and the composite partition layer 5 defines the air hole 8 connected to the inflatable cavity 9 to realize airflow inside the multiple inflatable chambers through the air hole 8. In an illustrated embodiment, the air hole 8 can be defined on the first oblique partition 521, the second oblique partition 522, the first transverse partition 531, or the second transverse partition 532, thereby to facilitate better airflow in each inflatable chamber and ensure gas flow inside the inflatable cavity 9.

The disclosure has a reasonable structure and strong practicality, making a structure of the inflatable mattress (i.e., the anti-collapse inflatable mattress) more stable and safe, and better preventing the collapse of the inflatable mattress.

The above are only the illustrative embodiments of the disclosure, which do not limit the scope of the protection of the disclosure. Any equivalent structural transformation made based on the disclosure and the attached drawings of the disclosure, or a direct/an indirect application of the disclosure in other related art, under the inventive concept of the disclosure, is included in the scope of the protection of the disclosure.

What is claimed is:

1. An anti-collapse inflatable mattress, comprising: an inflatable mattress body;

wherein the inflatable mattress body comprises: a top sheet, a side sheet, and a bottom sheet; and the top sheet, the side sheet, and the bottom sheet together define an inflatable cavity;

wherein the anti-collapse inflatable mattress further comprises: a first vertical partition layer disposed in the inflatable cavity, and the first vertical partition layer comprises: a first support frame and a second support frame, and the first support frame and the second support frame are disposed in a cross manner;

wherein a top portion of the first support frame and a top portion of the second support frame are connected to the top sheet; a bottom portion of the first support frame and a bottom portion of the second support frame are connected to the bottom sheet; and the first support frame and the second support frame intersect in an X shape; and wherein the inflatable mattress body further comprises: a composite partition layer; the composite partition layer comprises: a surrounding partition, an oblique partition, and a transverse partition; the oblique partition is disposed on the surrounding partition, and the transverse partition is disposed on the oblique partition; and the oblique partition is connected to the top sheet, and the transverse partition is connected to the side sheet.

2. The anti-collapse inflatable mattress as claimed in claim 1, wherein the anti-collapse inflatable mattress further comprises: a second vertical partition layer and a third vertical partition layer that are disposed in the inflatable cavity; and the first vertical partition layer, the second vertical partition layer, and the third vertical partition layer are identical in shape and size.

3. The anti-collapse inflatable mattress as claimed in claim 2, wherein the first support frame and the second support frame are made of a hard material or a soft material.

4. The anti-collapse inflatable mattress as claimed in claim 1, wherein the inflatable mattress body further comprises: an inflation port.

5. The anti-collapse inflatable mattress as claimed in claim 4, wherein the inflatable mattress body further comprises: a motor inflation port disposed at a side of the inflation port.

6. The anti-collapse inflatable mattress as claimed in claim 5, wherein the composite partition layer defines an air hole connected to the inflatable cavity.

7. An anti-collapse inflatable mattress, comprising:

a top sheet, disposed on a top of the anti-collapse inflatable mattress;

a bottom sheet, disposed on a bottom of the anti-collapse inflatable mattress;

a side sheet, disposed between the top sheet and the bottom sheet; wherein the side sheet is connected between the top sheet and the bottom sheet to define an inflatable cavity with the top sheet and the bottom sheet;

a plurality of vertical partition layers, disposed in the inflatable cavity and connected between the top sheet and the bottom sheet; and a composite partition layer, disposed in the inflatable cavity and connected to the top sheet, the bottom sheet, and the side sheet; wherein the composite partition layer surrounds the plurality of vertical partition layers;

wherein the composite partition layer comprises:

a surrounding partition, surrounding the plurality of vertical partition layers;

a first oblique partition, connected between the top sheet and the surrounding partition;

a second oblique partition, connected between the surrounding partition and the bottom sheet;

a first transverse partition, connected between the first oblique partition and the side sheet; and a second transverse partition, connected between the second oblique partition and the side sheet.

8. The anti-collapse inflatable mattress as claimed in claim 7, wherein each of the plurality of vertical partition layers comprises: a first support frame and a second support frame; the first support frame and the second support frame are disposed in a cross manner; a top portion of the first support frame and a top portion of the second support frame are connected to the top sheet; and a bottom portion of the first support frame and a bottom portion of the second support frame are connected to the bottom sheet.

9. The anti-collapse inflatable mattress as claimed in claim 7, wherein the first oblique partition and the second oblique partition are symmetrically disposed relative to the surrounding partition, and the first transverse partition and second transverse partition are symmetrically disposed relative to the surrounding partition.

10. The anti-collapse inflatable mattress as claimed in claim 9, wherein the composite partition layer defines an air hole connected to the inflatable cavity.

* * * * *